US008296969B2

(12) United States Patent
Granger et al.

(10) Patent No.: US 8,296,969 B2
(45) Date of Patent: Oct. 30, 2012

(54) TRIPLE DENSITY GEL HEEL CUPS

(75) Inventors: David Bradley Granger, Lorena, TX (US); Jacob Martinez, Temple, TX (US); Duane M. Sulak, Waco, TX (US)

(73) Assignee: Spenco Medical Corporation, Waco, TX (US)

( * ) Notice: Subject to any disclaimer, the term of this patent is extended or adjusted under 35 U.S.C. 154(b) by 400 days.

(21) Appl. No.: 12/682,337

(22) PCT Filed: Jan. 12, 2009

(86) PCT No.: PCT/US2009/030716
§ 371 (c)(1),
(2), (4) Date: Apr. 9, 2010

(87) PCT Pub. No.: WO2009/091687
PCT Pub. Date: Jul. 23, 2009

(65) Prior Publication Data

US 2010/0212188 A1 Aug. 26, 2010

Related U.S. Application Data

(60) Provisional application No. 61/021,535, filed on Jan. 16, 2008.

(51) Int. Cl.
*A43B 23/08* (2006.01)

(52) U.S. Cl. ..... 36/37; 36/69; 36/173

(58) Field of Classification Search ..... 36/43, 44, 36/37, 69, 71, 173, 178
See application file for complete search history.

(56) References Cited

U.S. PATENT DOCUMENTS 4,179,826 A * 12/1979 Davidson ..... 36/69
4,223,457 A * 9/1980 Borgeas ..... 36/35 B
4,325,380 A * 4/1982 Malkin ..... 36/140
4,346,525 A * 8/1982 Larsen et al. ..... 36/69
4,928,404 A * 5/1990 Scheuermann ..... 36/37
(Continued)

FOREIGN PATENT DOCUMENTS

KR 10-0780086 B1 11/2007

*Primary Examiner* — Marie Patterson
(74) *Attorney, Agent, or Firm* — Hemingway & Hansen, LLP; Eugenia S. Hansen

(57) ABSTRACT

A triple density heel cup is disclosed which comprises a generally heel-shaped substrate having a length extending from a heel portion of an integral wall to a front border, which front border in use is adapted to underlie a portion of the arch area of a human foot. The heel-shaped substrate comprises a structural gel layer having a foot receiving surface and a shoe side surface. A generally flat portion of the foot receiving surface will lie adjacent the bottom of a wearer's foot in use and the integral wall which is adapted to lie adjacent the back of wearer's heel and portion of the side of a wearer's heel in use, said integral wall having an apex of maximum height, said wall tapering down in height from said apex toward said front border; The shoe side surface defines a channel formed in said structural gel adapted to receive a reinforcing component which is secured to said structural gel in said channel and is made of a denser material than said structural gel. This provides support to the heel cup and the foot A heel cushion is secured to said structural gel in a heel cushion area defined by the structural gel on the bottom surface of the heel cup. In a preferred embodiment, the heel cushion utilizes honeycomb technology to provide increased cushioning and energy return.

14 Claims, 4 Drawing Sheets

U.S. PATENT DOCUMENTS 5,067,256 A * 11/1991 Darby ..... 36/69
5,172,494 A * 12/1992 Davidson ..... 36/35 R
6,497,057 B1 12/2002 Lee et al.
6,536,137 B1 * 3/2003 Celia ..... 36/28
6,631,568 B2 10/2003 Howlett et al.
7,168,188 B2 * 1/2007 Auger et al. ..... 36/69
2003/0121180 A1 7/2003 Poe
2005/0108899 A1 * 5/2005 Kielt et al. ..... 36/71

* cited by examiner

TRIPLE DENSITY GEL HEEL CUPS

CROSS REFERENCE TO RELATED APPLICATIONS

This application claims the benefit of U.S. Provisional Patent Application 61/021,535, filed 16 Jan. 2008.

STATEMENT REGARDING FEDERALLY SPONSORED RESEARCH OR DEVELOPMENT

Not applicable.

TECHNICAL FIELD

This invention relates to the field of heel supports worn inside shoes.

DETAILED DESCRIPTION

Figure 1:
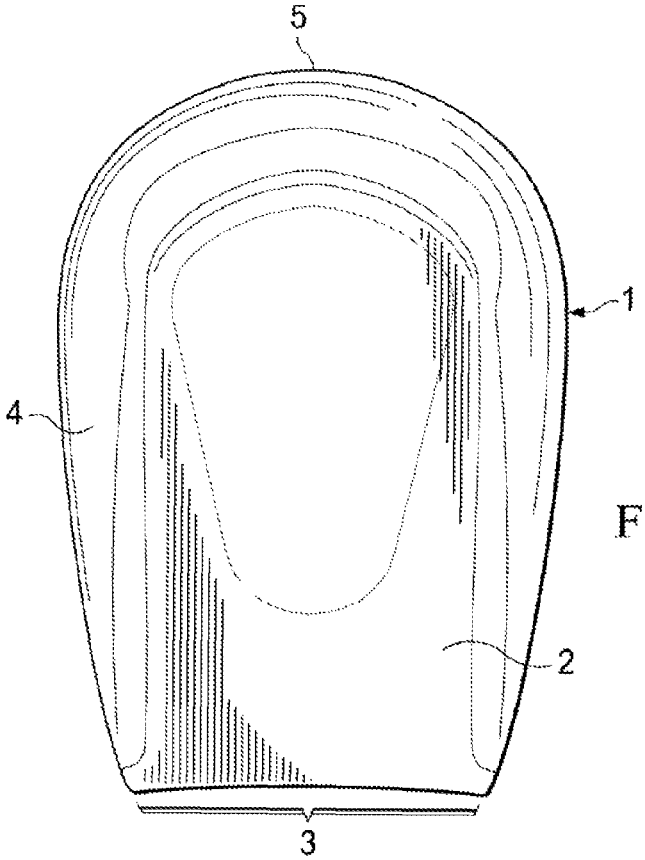
FIG. 1 is a top plan view of the preferred embodiment.

A triple density heel cup or support ("TD heel cup") is disclosed that advantageously absorbs shock and provides support to the heel area of the foot. From a top view, the TD heel cup extends from a back heel wall to a front border. In use, the back heel wall will lie adjacent the back of the wearer's heel formed by the calcaneous or os tarsi fibulare. The front border will lie adjacent the bottom of the wearer's foot essentially in or near the arch area of the wearer's foot. It is contemplated that a wearer's foot may be covered with hosiery and when reference is made herein to the foot, it is intended to include feet clad with hosiery, socks and the like unless specified otherwise.

The TD heel cup comprises a generally flat area which in use will contact the bottom of the wearer's foot. Integral to the flat area and extending upwardly therefrom is a wall portion which is of maximum height at the back center of the heel cup. From the point of the wall's maximum height at the back center of the heel cup, the wall gradually tapers down in height to or nearly to the level of the flat area at the front border of the heel cup. The interior portion of the heel cup is adapted to receive a wearer's foot and lie adjacent thereto in use and the exterior portion of the heel cup is adapted to lie adjacent the shoe of the user. The interior portion comprises a gel material. The exterior portion comprises a gel material, a reinforcement component attached to said gel material, and a heel cushion inserted into an indentation integrally formed in the gel and on the bottom surface of the gel.

The gel material is preferably comprised of thermoplastic elastomer gel, also known as TPE gel. TPE gel is preferred over polyurethane (PU) gel for use in the invention due to its greater resiliency from its thermoplastic properties. TPE gel is desirable because it can set up in 20-30 seconds in a molding process, while other materials, for example PU gel can take minutes. If a material takes minutes to set up, it may not be suitable for injection molding in an efficient manner, but would necessitate different components of the heel cup to be molded in parts and then assembled. The material used for the gel is preferably strong to allow the heel cup to be made relatively thin, but to remain strong. The thin nature of the heel cup is preferred to allow for greater foot space in shoes designed with lesser space in the foot cavity of the shoe, such as dress shoes. The heel cup is also, however, suitable for use in shoes with a larger foot cavity, such as athletic shoes.

There are various types of commercially available TPE gel, two of which are known as a thermoplastic polyurethane elastomer ("TPU") gel and thermoplastic rubber gel ("TPR") gel. TPU gel may be selected if the color characteristics are of high importance, as it provides better color characteristics than TPR gel. In addition, TPU is more durable and easier to mold than TPR gel so it is desirable for use in making the invention if it is desired to impart these characteristics to the final product or to the process for making the insole. A disadvantage to TPU gel has heretofore been its higher cost as compared with other TPE gels such as TPR gel. TPR may also be used for the gel and has the necessary properties. Other gels can be used, but it is preferred that the gel used have the characteristics described in the following paragraphs.

The preferred gel has a low compression set. Compression Set is defined as the amount of permanent set a sample displays after being compressed at a stated amount of percentage (%) at a specific temperature for a given amount of time and recovery period. In a preferred embodiment, the Compression Set is <11±2% for the gel layer. In order to select an appropriate gel for use in the invention, gel can be tested with a testing device used for the measurement of the compression set, or shock, in accordance with ASTM F1614-95, "Standard Test Method for Shock Attenuating Properties of Materials Systems for Athletic Footwear," ASTM International For example, CompITS or Computerized Impact Testing System from Exeter Research is a standard machine that tests shock in compliance with ASTM F1614-95.

Tensile and Tear strengths: The preferred embodiment was found to have a tensile strength and tear strength of around 1.2 MPa and 12 kN/m for the gel layer.

Breaking Elongation Rate: The preferred embodiment was found to have a breaking elongation rate of 900% for the gel layer.

A Shore/Asker Hardness test provides a measure of hardness. In a most preferred embodiment, the gel layer measures 24±3 Asker C.

The Shore/Asker hardness is measurable with a commercially available durometer. The material to be tested is placed on a hard flat surface. The Asker tester is equipped with a "C" scale and proper indentor type, typically a hemispherical type. The Asker tester is placed on the material to be tested with no additional pressure. The needle deflects to provide the reading.

The reinforcement component is a material of a more rigid density than the gel and is attached to the shoe side surface of the heel cup to said gel layer. In a preferred embodiment, the reinforcement component extends across the back of the heel upright wall near the top of the wall. The reinforcement component then curves downwardly toward the base of the heel cup and then extends along the side of the heel cup and forward to the front border of the heel cup.

The reinforcement component may be made of any material having similar characteristics to polypropylene (PP), polyvinyl chloride (PVC), thermoplastic vulcanizate (TPV), or thermoplastic rubber (TPR). Preferably, the reinforcement component is made of TPR. Preferably, the hardness of the reinforcement component is about 70±3 Asker C.

The heel cushion in the preferred embodiment is shaped with a wide base designed to correspond with the fatty area of the heel and generally tapers to a U-shape corresponding with the heel opening defined by the gel material of the heel cup. The shape described is effective for cradling and cushioning the heel.

In a preferred embodiment, the Compression Set is <11±2% for the heel cushion. In order to select an appropriate gel for use in the invention, gel can be tested with a testing device used for the measurement of the compression set, or shock, in accordance with ASTM F1614-95, "Standard Test Method for Shock Attenuating Properties of Materials Systems for Athletic Footwear," ASTM International. For example, CompITS or Computerized Impact Testing System from Exeter Research is a standard machine that tests shock in compliance with ASTM F1614-95.

Tensile and Tear strengths: The preferred embodiment was found to have a tensile strength and tear strength of around 1.0 MPa and 10.6 kN/m for the heel cushion.

Breaking Elongation Rate: The preferred embodiment was found to have a breaking elongation rate of 950% for the heel cushion.

A Shore/Asker Hardness test provides a measure of hardness. In a most preferred embodiment, the heel cushion measures 20±3 Asker C.

The heel cushion is preferably comprised of thermoplastic rubber gel, also known as TPR gel. Other gels can be used, but it is preferred that the gel used have the following characteristics:

The shoe surface of the heel cushion may be provided with areas which exhibit advanced cushioning features. A preferred embodiment incorporates honeycomb technology, by which a portion of the gel layer is molded into a honeycomb pattern. Honeycomb patterns have long been known to deflect force by temporarily deforming then returning to original configuration. See "Recovery Systems Guide", Irvin Industries, 1978 (cited in Fisher, Aerobraking and Impact Attenuation, 1995). The portion of the gel layer to be molded to a honeycomb pattern is the high-impact zone of the heel of the invention.

In a most preferred embodiment, the hardness of the base layer measures 24±3 Asker C, the pad layer measures 20±3 Asker C, and the reinforcement component measures 70±3 Asker C.

The total thickness, height, length, and width of the heel cup can vary depending on the size of the heel cup used which can be adapted for various shoe sizes or ranges of shoe sizes. The product can be produced in many sizes. In most examples of the product, the total thickness can be from about 20 to about 27 mm and preferably from about 23.5 mm to about 26.5 mm at the apex of the back of the heel area. The length is from about 88 mm to about 108 mm and preferably from about 90 mm to about 106.5 mm and the width is from about 60 mm to about 75 mm and preferably from about 63 mm to about 72.5 mm near the back of the heel area, and from about 53 mm to about 65 mm and preferably from about 55.5 mm to about 63 mm near the front border. Is there a ratio of width/height you use to calculate size for the various shoes?

The gel material, the heel cushion, and the reinforcement component are preferably formed and secured to each other through a process of injection molding. Preferably, the molds used to make the heel cup have two-sided contour. This allows for quicker assembly so that the mold does not have to be changed during the injection molding process. The gel material is molded on one side of the mold and the reinforcement component and heel cushion is molded on the opposite side of the mold. Standard injection molding assembly-line processes are preferably utilized, but any molding process which results in the structure with the properties herein disclosed can be used are known in the art.

The preferred embodiment of the invention is a triple density heel cup. The first density is that of the gel of the structure. The second density is of the TPR gel of the heel cushion. The third density is of the reinforcement component. The triple density of the insole provides the following advantages: the dual density gel layers in the heel region provide increased cushioning and comfort in the area of primary stress to the heel. The TPR comfort gel comprising the heel cushion provides good energy return and cushioning, preferably in the range of 44±4% energy return. The TPR or TPU gel comprising the base layer of the invention serves to aid in the energy return process. The reinforcement component provides support for the heel and for the heel cup.

Now referring to the drawings which illustrate the preferred embodiment of the invention (1), FIG. 1 shows a view of the top (foot side) of the heel cup. Referring to FIG. 1, structural gel layer (1) has a flat area (2) a front border (3) and an integral upwardly extending wall (4) which reaches its apex at (5). In use apex (5) will be essentially adjacent the midpoint of the back of the wearer's heel.

Figure 2:
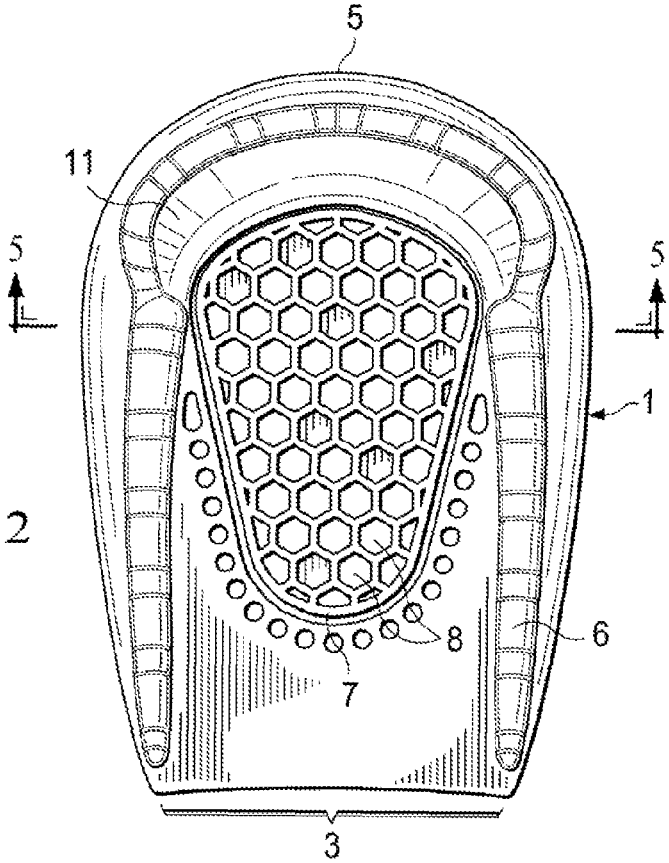
FIG. 2 is bottom plan view of the preferred embodiment.

A view of the bottom (shoe side) of the heel cup is best seen in FIG. 2. As shown in FIG. 2, reinforcement component (6) is also secured to the bottom (shoe) side of the structural gel layer (1) along each side and extending to the front border (3). Also visible in FIG. 2 is heel cushion (7) which preferably comprises a plurality of honeycomb areas (8). Heel cushion (7) is illustrated as being secured to an indentation in the gel which is on the bottom side of the heel cup.

Figure 3:
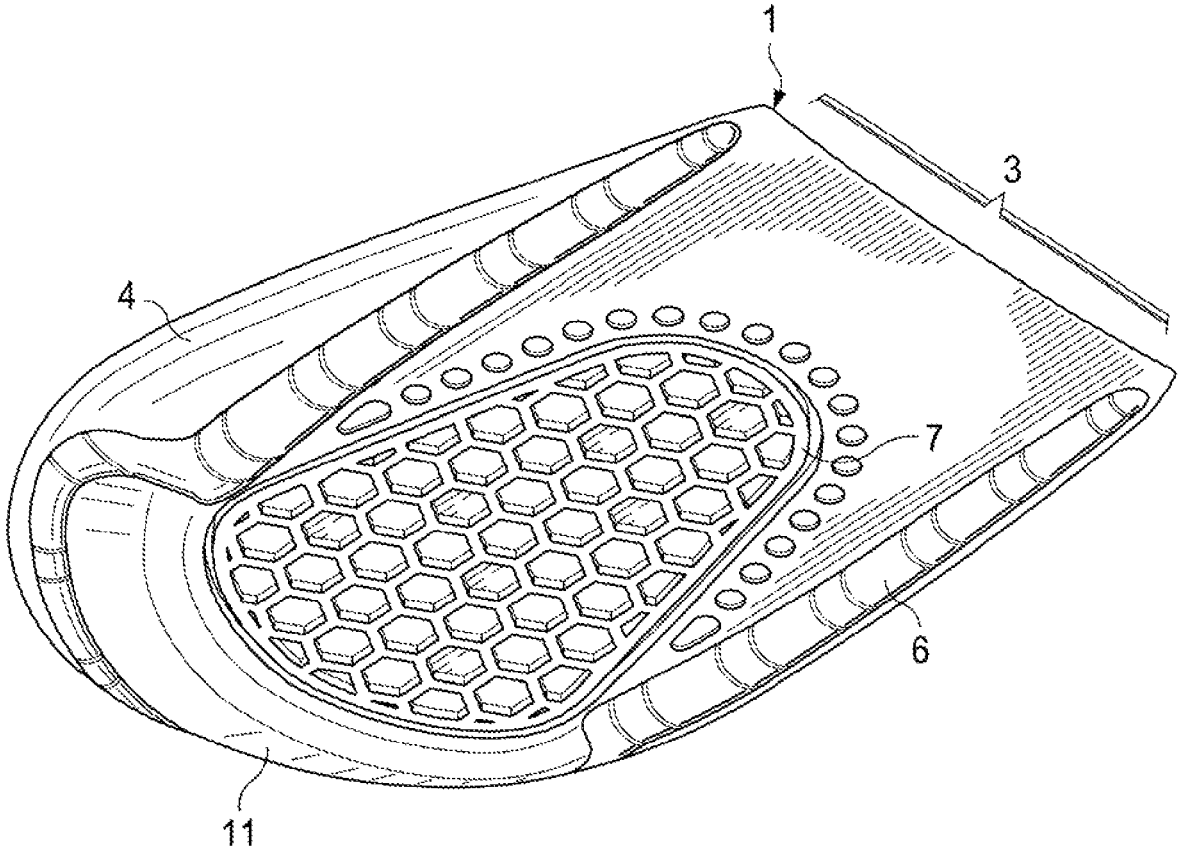
FIG. 3 is a perspective view the preferred embodiment.

Referring to bottom perspective view FIG. 3 structural gel layer (1) and reinforcement component (6) are visible, as well as heel cushion (7), upwardly extending wall (4), front border (3), and back heel end (11).

Figure 4:
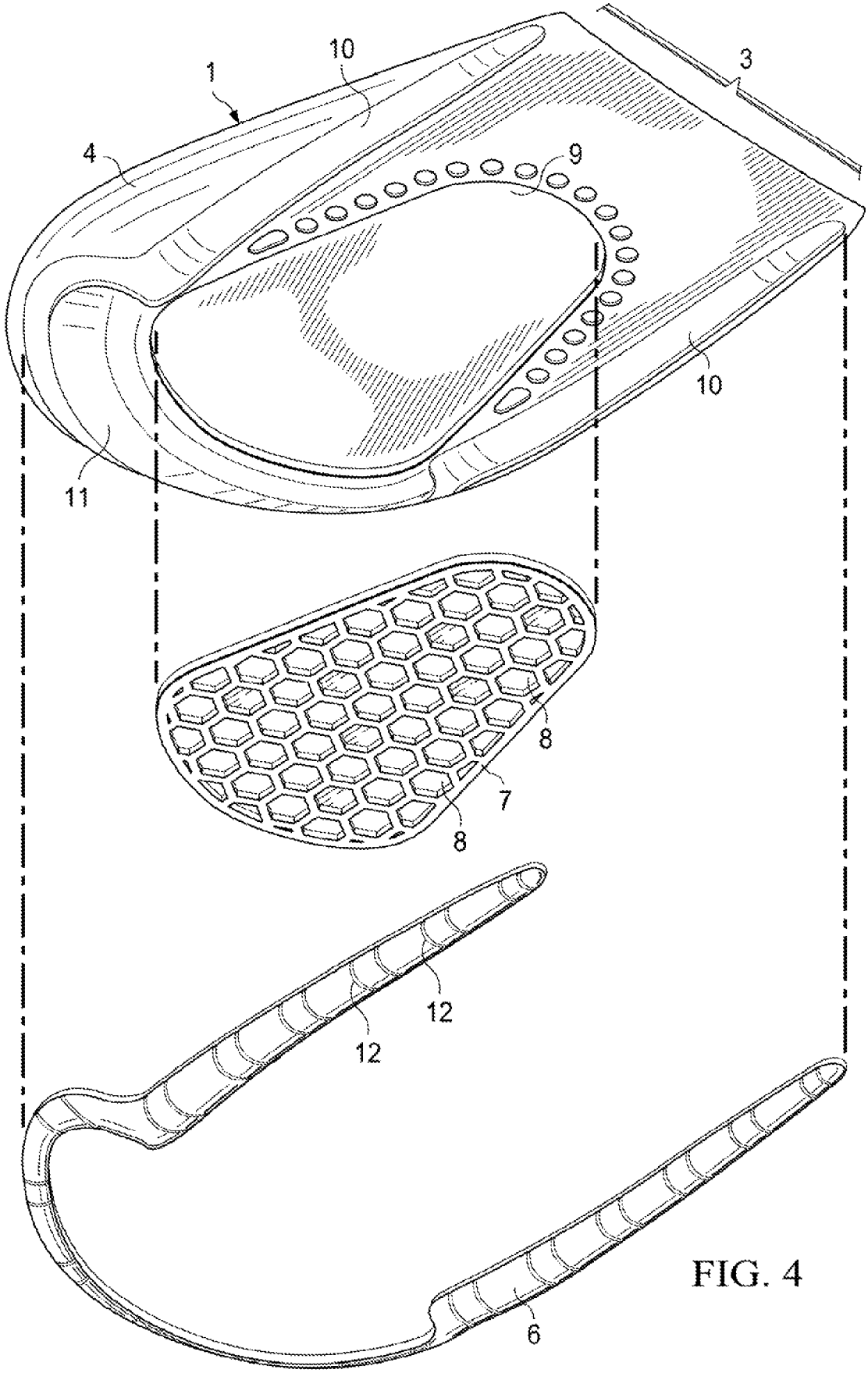
FIG. 4 is an exploded view of the preferred embodiment.

Referring now to exploded view FIG. 4, one can see indented heel cushion area (9) and channel (10) which are defined by structural gel layer (1). Heel cushion (7) is shaped to fit into heel cushion area (9) and to form a part of a generally planar surface on the bottom of the heel cup. Channel (10) is adapted to receive reinforcement component (6) so that a generally continuous shoe side surface is formed without impeding protrusions. Channel (10) and reinforcement component (6) essentially follow the heel shaped curvature of upwardly extending wall (4). Reinforcement component (6) provides a stabilizing structure conforming to the shape of the back of the heel of the wearer's foot. Reinforcement component (6) thus provides stability to the heel and to the structural gel layer from the back of the heel receiving area to the front border (3).

In a preferred embodiment, scoring marks (12) are provided in reinforcement component (6). The scoring marks are effective in providing strength to the insole and help keep the heel cup from moving.

Heel cushion (7) is positioned in the heel cushion area (9) and preferably incorporates honeycomb cushioning technology (8). This area provides advanced cushioning to the weight placed upon the heel of the user's foot.

Preferably, the back heel end (11) as shown in FIG. 3, of the heel cup is thicker than the front border area. This is best seen in FIG. 4. Generally, there will be less space in a shoe for the fore region of the heel cup and the need for increased cushioning is greater in the area where the heel cushion is placed.

Figure 5:
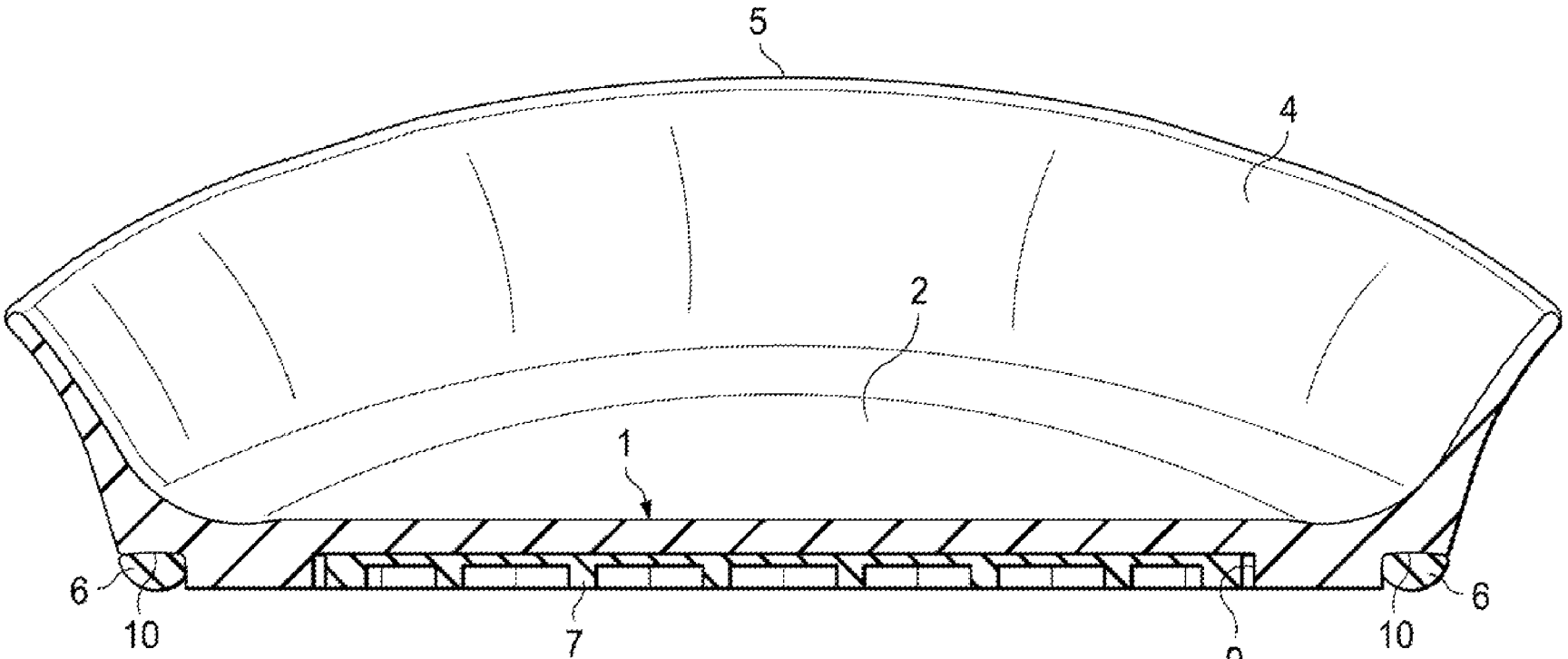
FIG. 5 is a sectional view of the preferred embodiment, taken along 5-5 in FIG. 2.

FIG. 5 shows a cross-section of the heel cup from line 5-5 in FIG. 2. One can see the structural gel layer (1), the channel (10), the reinforcement component (6), the integral upwardly extending wall (4), the apex thereof (5), the heel cushion area (9) and the fiat area (2).

In the preferred manufacture process, the cradle and heel pad assemblies are injection-molded individually. Once created, the cradle and heel pad are placed in the base mold where the base gel is injected, bonding the cradle and heel pad to the invention.

We claim:

1. A triple density heel cup, comprising:

a generally heel-shaped substrate having a length extending from a heel back wall to a front border, which front border is positioned to underlie a portion of the arch area of the bottom of a wearer's foot when in use;

said heel-shaped substrate comprising a structural gel layer having a foot receiving surface and a shoe side surface;

said foot receiving surface having a flat area which is adapted to underlie the bottom of a wearer's foot in use and an upwardly extending integral wall which is adapted to lie adjacent the back and sides of said wearer's heel in use, said integral wall having a back apex of maximum height, said integral wall tapering down in height from said back apex toward said front border;

said shoe side surface defining a channel formed in said structural gel layer adapted to receive a reinforcement component;

a reinforcement component secured to said structural gel layer in said channel; said reinforcement component comprising a denser material than said structural gel layer, said reinforcement component having a curvature complementary to said upwardly extending integral wall in the area of the back of the heel, said curvature descending downwardly toward the base of the heel cup and then extending along the side of the heel cup and forward to said front border;

said shoe side surface further defining a heel cushion area; and a heel cushion secured to said structural gel layer in said heel cushion area.

2. The heel cup of claim 1, wherein said heel cushion comprises a second density gel.

3. The heel cup of claim 2, wherein said second density gel integrally forms a honeycomb pattern.

4. The heel cup of claim 1, wherein said structural gel layer is selected from thermoplastic polyurethane elastomer gel and thermoplastic rubber gel.

5. The heel cup of claim 1, wherein said reinforcement component is made of material selected from the group consisting of polypropylene, polyvinyl chloride, thermoplastic vulcanizate and thermoplastic rubber.

6. The heel cup of claim 5, wherein said reinforcement component is made of thermoplastic rubber.

7. The heel cup of claim 6, wherein said reinforcement component has a hardness of about 70±3 Asker C.

8. The heel cup of claim 1, wherein said reinforcement component further comprises scoring marks.

9. The heel cup of claim 1, wherein said structural gel layer has a compression set <11±2%.

10. The heel cup of claim 1, wherein said structural gel layer has a tensile strength and tear strength of around 1.2 MPa and 12 kN/m.

11. The heel cup of claim 1, wherein said structural gel layer has a breaking elongation rate of about 900%.

12. The heel cup of claim 1, wherein said structural gel layer has a Shore/Asker hardness of about 24±3 Asker C.

13. The heel cup of claim 2, wherein said heel cushion has a compression set of about <11±2% , a tensile and tear strength of about 1.0 MPa and 10.6 kN/m, and a breaking elongation rate of about 950%, and a Shore/Asker Hardness of about 20±3 Asker C.

14. The heel cup of claim 2, wherein said heel cushion comprises thermoplastic rubber gel.

* * * * *